US010805737B2

(12) United States Patent
Zuo

(10) Patent No.: US 10,805,737 B2
(45) Date of Patent: Oct. 13, 2020

(54) MICROPHONE, MOBILE TERMINAL AND ELECTRONIC DEVICE

(71) Applicant: GUANGDONG OPPO MOBILE TELECOMMUNICATIONS CORP., LTD., Dongguan, Guangdong (CN)

(72) Inventor: Zhouquan Zuo, Guangdong (CN)

(73) Assignee: GUANGDONG OPPO MOBILE TELECOMMUNICATIONS CORP., LTD., Dongguan, Guangdong (CN)

( * ) Notice: Subject to any disclaimer, the term of this patent is extended or adjusted under 35 U.S.C. 154(b) by 0 days.

(21) Appl. No.: 16/204,870

(22) Filed: Nov. 29, 2018

(65) Prior Publication Data

US 2019/0297429 A1 Sep. 26, 2019

(30) Foreign Application Priority Data

Mar. 22, 2018 (CN) ..... 2018 1 0244742
Mar. 22, 2018 (CN) ..... 2018 2 0401154 U

(51) Int. Cl.
*H04R 1/34* (2006.01)
*H04R 19/04* (2006.01)
(Continued)

(52) U.S. Cl.
CPC ..... *H04R 19/04* (2013.01); *H04R 1/021* (2013.01); *H04R 1/08* (2013.01); *H04R 1/2823* (2013.01); *H04R 2499/11* (2013.01)

(58) Field of Classification Search
CPC ... H04R 1/342; H04R 25/604; H04R 2499/11
See application file for complete search history.

(56) References Cited

U.S. PATENT DOCUMENTS 5,511,130 A * 4/1996 Bartlett ..... H04M 1/19 381/170
5,745,588 A * 4/1998 Bartlett ..... H04R 1/2869 381/170
(Continued)

FOREIGN PATENT DOCUMENTS

CN 204707162 U 10/2015
CN 106210938 A 12/2016
(Continued)

OTHER PUBLICATIONS

European search report for Application No. EP18208297, dated Jun. 7, 2019 (8 pages).
(Continued)

*Primary Examiner* — Fan S Tsang
*Assistant Examiner* — Ryan Robinson
(74) *Attorney, Agent, or Firm* — Ladas & Parry LLP

(57) ABSTRACT

The present disclosure provides a microphone adapted to be installed inside a case of an electronic device, an electronic device and a mobile terminal. The microphone includes a housing; a vibrating membrane set inside the housing, wherein the housing defines a sound collecting hole facing the vibrating membrane; and a connector adapted to connect the housing with the case of the electronic device and defining a first sound guiding tube and a second sound guiding tube; wherein, one end of the first sound guiding tube is communicated with the first sound entering hole while the other end of the first sound guiding tube is communicated with the second sound entering hole, a first end of the second sound guiding tube is communicated with the first sound guiding tube, and a second end of the second sound guiding tube is communicated with the sound collecting hole.

17 Claims, 7 Drawing Sheets

(51) Int. Cl.

| | |
|---|---|
| ***H04R 1/02*** | (2006.01) |
| ***H04R 1/08*** | (2006.01) |
| *H04R 1/28* | (2006.01) |

(56) References Cited

U.S. PATENT DOCUMENTS

| | | | | |
|---|---|---|---|---|
| 7,894,621 | B2 * | 2/2011 | Jensen | H04R 1/086 381/322 |
| 9,066,172 | B2 * | 6/2015 | Nguyen | H04R 1/02 |
| 9,854,074 | B2 * | 12/2017 | Fernandes | H04M 1/0254 |
| 9,888,308 | B2 * | 2/2018 | Eichfeld | H04R 1/02 |
| 2007/0237338 | A1 * | 10/2007 | Konchitsky | H04M 1/035 381/91 |
| 2013/0163790 | A1 * | 6/2013 | Shimizu | H04R 3/00 381/122 |
| 2018/0077489 | A1 | 3/2018 | Yang | |
| 2018/0249261 | A1 * | 8/2018 | Wichmann | H04R 25/604 |

FOREIGN PATENT DOCUMENTS

| | | | |
|---|---|---|---|
| CN | 206807770 | U | 12/2017 |
| CN | 107820147 | A | 3/2018 |
| CN | 108307283 | A | 7/2018 |
| CN | 208128822 | U | 11/2018 |
| JP | 2008306292 | A | 12/2008 |
| JP | 2010278888 | A | 12/2010 |
| JP | 2011223324 | A | 11/2011 |

OTHER PUBLICATIONS

First search from China patent office in a counterpart Chinese patent Application 201810244742.7, dated Jun. 5, 2019 (7 pages).

International search report for Application No. PCT/CN2018/116390, dated Jan. 30, 2019 (10 pages).

Indian First Examination Report, Indian application No. 201814046222, dated Aug. 14, 2020 (6 pages).

* cited by examiner

MICROPHONE, MOBILE TERMINAL AND ELECTRONIC DEVICE

CROSS-REFERENCE TO RELATED APPLICATIONS

The present application claims foreign priority of Chinese Patent Application No. 201810244742.7, filed on Mar. 22, 2018, and Chinese Application No. 201820401154.5, filed on Mar. 22, 2018 in the State Intellectual Property Office of China, the entire contents of which are hereby incorporated by reference.

TECHNICAL FIELD

The described embodiments of the present disclosure generally relate to electronic devices, and in particular to a microphone, a mobile terminal and an electronic device with the microphone.

BACKGROUND

Electronic devices, such as cell phone, laptop, portable media displayer and digital camera, generally include one or more microphones. For example, no less than two microphones may usually be included in a cell phone. For each microphone, a sound entering hole may be formed on the case of the cell phone. The sound entering hole is directly communicated with the sound collecting hole of the microphone. Since the sound entering hole usually has a small diameter, it is easy to be plugged by dust. Thus, performance of the microphone may be disadvantaged, and it is hard to clean the dust inside the sound entering hole.

SUMMARY

The present disclosure provides a microphone, an electronic device and a mobile terminal in order to solve the above-mentioned problem.

In an aspect, a microphone is provided. The microphone may be adapted to be installed inside a case of an electronic device. The case of the electronic device may define a first sound entering hole and a second sound entering hole. The microphone includes: a housing; a vibrating membrane set inside the housing, wherein the housing defines a sound collecting hole facing the vibrating membrane; and a connector adapted to connect the housing with the case of the electronic device and defining a first sound guiding tube and a second sound guiding tube; wherein, one end of the first sound guiding tube is communicated with the first sound entering hole while the other end of the first sound guiding tube is communicated with the second sound entering hole, a first end of the second sound guiding tube is communicated with the first sound guiding tube, and a second end of the second sound guiding tube is communicated with the sound collecting hole.

In another aspect, an electronic device is provided. The electronic device includes: a case defining a first sound entering hole and a second sound entering hole; a microphone, comprising: a housing; and a vibrating membrane set inside the housing, wherein the housing defines a sound collecting hole facing the vibrating membrane; and a connector connecting the housing of the microphone and the case, and defining a first sound guiding tube and a second sound guiding tube; wherein, one end of the first sound guiding tube is communicated with the first sound entering hole while the other end of the first sound guiding tube is communicated with the second sound entering hole, a first end of the second sound guiding tube is communicated with the first sound guiding tube, and a second end of the second sound guiding tube is communicated with the sound collecting hole.

In yet another aspect, a mobile terminal is provided. The mobile terminal includes: a case defining a first sound entering hole and a second sound entering hole, wherein the first and second sound entering holes are communicated with inside and outside of the case; a microphone received in the case and comprising: a housing defining a sound collecting hole; a vibrating membrane connected with the housing, wherein the sound collecting hole faces the vibrating membrane; a first sound guiding tube formed in the case, and communicated with the first sound entering hole and the second sound entering hole; and a second sound guiding tube formed in the case, and communicated with the first sound guiding tube and the sound collecting hole.

BRIEF DESCRIPTION OF THE DRAWINGS

In order to clearly explain the technical solutions in the embodiments of the present disclosure, the drawings used in the description of the embodiments will be briefly described below. Obviously, the drawings in the following description are merely some embodiments of the present disclosure. For those of ordinary skill in the art, other drawings may also be obtained based on these drawings without any creative work.

DETAILED DESCRIPTION

Figure 1:
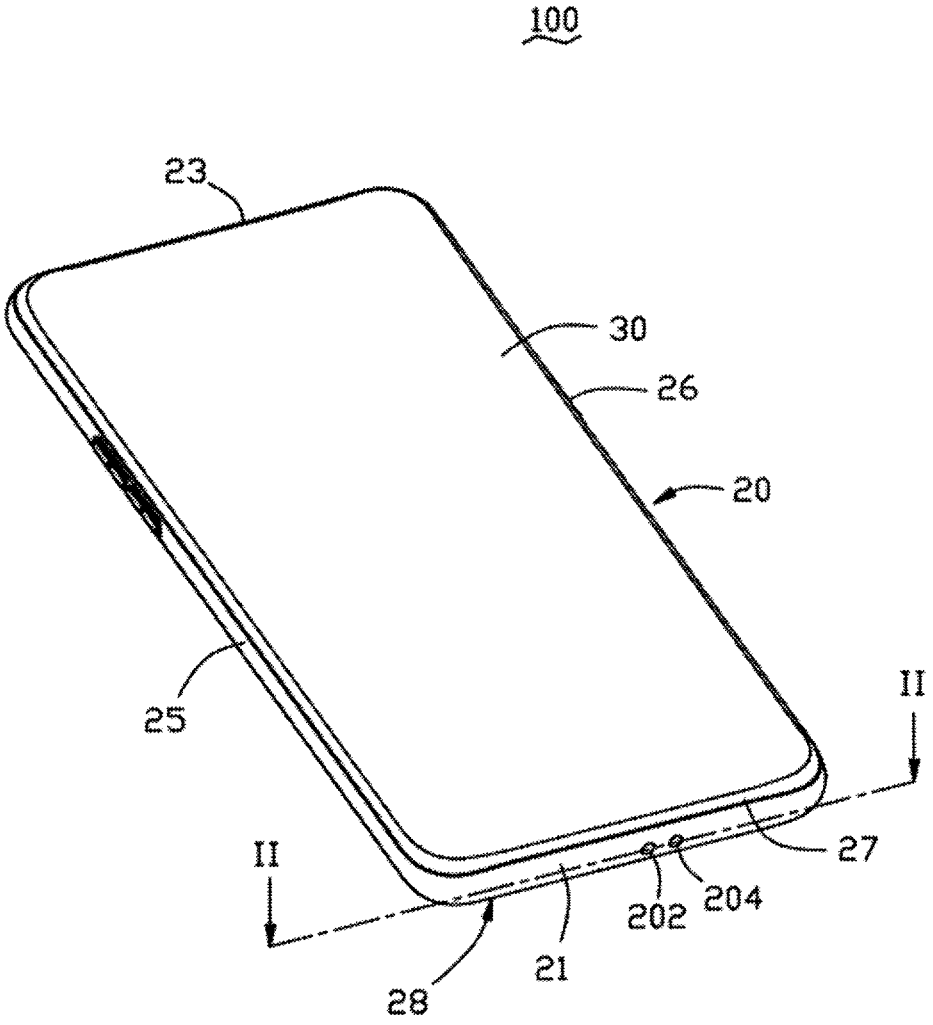
FIG. 1 is a perspective view of an electronic device according to an embodiment of the present disclosure.

The disclosure will now be described in detail with reference to the accompanying drawings and examples. Apparently, the described embodiments are only a part of the embodiments of the present disclosure, not all of the embodiments. All other embodiments obtained by a person of ordinary skill in the art based on the embodiments of the present invention without creative efforts shall fall within the protection scope of the present invention.

In the specification, it is to be understood that terms such as "top", "bottom", "left" and "right" should be construed to refer to the orientation as then described or as shown in the drawings under discussion. These relative terms are for convenience of description and do not require that the present disclosure be constructed or operated in a particular orientation. These terms should not be considered as limitation to the scope of the present disclosure.

In the specification, it is to be understood that terms such as "thickness" should be construed to refer to the orientation as then described or as shown in the drawings under discussion. These relative terms are for convenience of description and do not require that the present disclosure be constructed or operated in a particular orientation. These terms should not be considered as limitation to the scope of the present disclosure.

In an aspect, a microphone is provided. The microphone is adapted to be installed inside a case of an electronic device. The case of the electronic device defines a first sound entering hole and a second sound entering hole. The microphone includes: a housing; a vibrating membrane set inside the housing, wherein the housing defines a sound collecting hole facing the vibrating membrane; and a connector adapted to connect the housing with the case of the electronic device and defining a first sound guiding tube and a second sound guiding tube; wherein, one end of the first sound guiding tube is communicated with the first sound entering hole while the other end of the first sound guiding tube is communicated with the second sound entering hole, a first end of the second sound guiding tube is communicated with the first sound guiding tube, and a second end of the second sound guiding tube is communicated with the sound collecting hole.

In one embodiment, the first end of the second sound guiding tube may connect to a middle portion of the first sound guiding tube.

In one embodiment, the first sound guiding tube may have a straight configuration or an arc configuration.

In one embodiment, the first sound guiding tube may include multiple straight tubes connected together successively, and each two adjacent straight tubes may be smoothly connected by arc transition.

In one embodiment, the connector may define an accommodating space. The housing and the vibrating membrane are received in the accommodating space, and the accommodating space may be communicated with the second sound guiding tube through the sound collecting hole.

In one embodiment, the connector and the case of the electronic device may be integrally formed.

In one embodiment, the first sound entering hole and the second sound entering hole may be spaced apart and located on a same outer surface of the case of the electronic device.

In one embodiment, the first sound entering hole and the second sound entering hole may be located on two different outer surfaces of the case of the electronic device.

In one embodiment, the first sound entering hole and the second sound entering hole may be formed on two adjacent outer surfaces of the case of the electronic device.

In one embodiment, the first sound entering hole and the second sound entering hole may be formed on two opposite outer surfaces of the case of the electronic device.

In another aspect, an electronic device is provided. The electronic device includes: a case defining a first sound entering hole and a second sound entering hole; a microphone, comprising: a housing; and a vibrating membrane set inside the housing, wherein the housing defines a sound collecting hole facing the vibrating membrane; and a connector connecting the housing of the microphone and the case, and defining a first sound guiding tube and a second sound guiding tube; wherein, one end of the first sound guiding tube is communicated with the first sound entering hole while the other end of the first sound guiding tube is communicated with the second sound entering hole, a first end of the second sound guiding tube is communicated with the first sound guiding tube, and a second end of the second sound guiding tube is communicated with the sound collecting hole.

In one embodiment, the first sound entering hole and the second sound entering hole are spaced apart, and formed on a same outer surface of the case of the electronic device.

In one embodiment, the first sound entering hole and the second sound entering hole are formed on two adjacent outer surfaces of the case of the electronic device.

In one embodiment, the first sound entering hole and the second sound entering hole are formed on two opposite outer surfaces of the case of the electronic device.

In one embodiment, the connector defines an accommodating space; the microphone is received in the accommodating space, and the accommodating space is communicated with the second sound guiding tube through the sound collecting hole.

In one embodiment, the connector is integrally formed with the case. In another aspect, a mobile terminal is provided. The mobile terminal includes: a case defining a first sound entering hole and a second sound entering hole, wherein the first and second sound entering holes are communicated with inside and outside of the case; a microphone received in the case and comprising: a housing defining a sound collecting hole; a vibrating membrane connected with the housing, wherein the sound collecting hole faces the vibrating membrane; a first sound guiding tube formed in the case, and communicated with the first sound entering hole and the second sound entering hole; and a second sound guiding tube formed in the case, and communicated with the first sound guiding tube and the sound collecting hole.

In one embodiment, the case comprises a plurality of side walls comprising a top wall, a bottom wall, a front wall, a back wall, a left wall and a right wall, the plurality of side walls are connected together; the first sound entering hole and the second sound entering hole are both formed in a same one selected from the plurality of side walls.

In one embodiment, the case comprises a plurality of side walls comprising a top wall, a bottom wall, a front wall, a back wall, a left wall and a right wall, the plurality of side walls are connected together; the first sound entering hole and the second sound entering hole are respectively formed in two adjacent ones or two opposite ones selected from the plurality of side walls.

In one embodiment, an accommodating space is formed in the case, and the microphone is received in the accommodating space.

Figure 2:
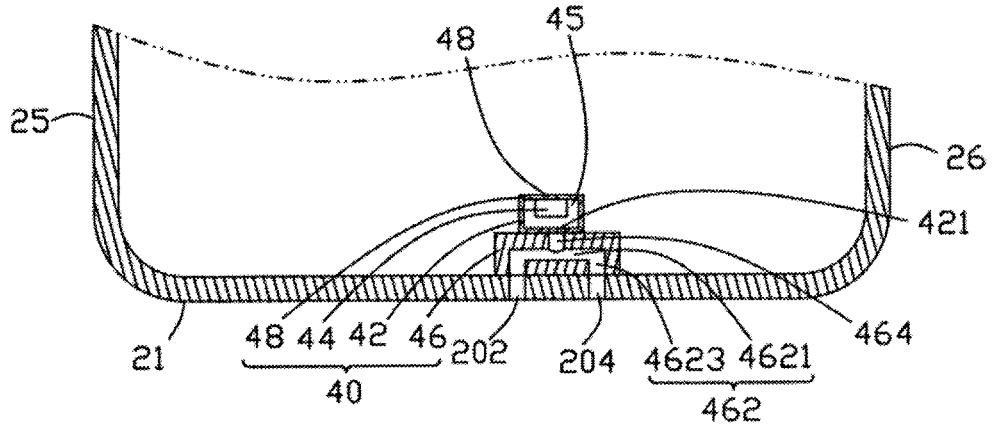
FIG. 2 is a sectional view taken along the line II-II of FIG. 1.

Referring to FIGS. 1 and 2, FIG. 1 is a perspective view of an electronic device according to an embodiment of the present disclosure. FIG. 2 is a sectional view taken along the line II-II of FIG. 1. The present disclosure provides an electronic device 100. The electronic device 100 may include a case 20 and a microphone 40 installed inside the case 20. The case 20 may define on its outer surfaces a first sound entering hole 202 and a second sound entering hole 204, and the first sound entering hole 202 and the second sound entering hole 204 may be spaced apart from each other. The microphone 40 may include a housing 42, a vibrating membrane 44 set inside the housing 42 and a connector 46. The housing 42 may define a sound collecting hole 421 facing the vibrating membrane 44. The connector 46 may define a first sound guiding tube 462 and a second sound guiding tube 464 communicated with each other. One end of the first sound guiding tube 462 may be communicated with the first sound entering hole 202 while the other end of the first sound guiding tube 462 may be communicated with the second sound entering hole 204. A first end of the second sound guiding tube 464 may be communicated with the first sound guiding tube 462 while a second end of the second sound guiding tube 464 may be communicated with the sound collecting hole 421. In this embodiment, the electronic device 100 may be a mobile terminal such as a smart phone.

In other embodiments, the electronic device 100 may be a laptop, a portable media displayer or a digital camera.

According to the present disclosure, a first sound entering hole 202 and a second sound entering hole 204 may be formed on the outer surface of the case 20 of the electronic device 100, and may be spaced apart from each other. The two ends of the first sound guiding tube 462 of the connector 46 may be respectively communicated with the first sound entering hole 202 and the second sound entering hole 204. The two ends of the second sound guiding tube 464 may be respectively communicated with the first sound guiding tube 462 and the sound collecting hole 421 of the microphone 40. Accordingly, when dust or external material is found in the first sound entering hole 202, the second sound entering hole 204 or the first sound guiding tube 462, it is possible to make a soft thin rod to enter the first sound entering hole 202, to pass through the first sound guiding tube 462, and to come out from the second sound entering hole 204 in order to push out dust or external material from the second sound entering hole 204. It is also possible to use high-pressure gas to blow into the first sound entering hole 202 so as to remove dust or external material from the second sound entering hole 204. When high-pressure gas is utilized to blow into the first sound entering hole 202, some of the gas can be vent from the second sound entering hole 204. In other words, not all of the high-pressure gas blows directly the vibrating membrane 44. Thus, the air pressure on the vibrating membrane 44 may be reduced so as to prevent the vibrating membrane 44 from damage.

The case 20 may include a bottom surface 21, a top surface 23, a left surface 25, a right surface 26, a front surface 27 and a back surface 28. The electronic device 100 may further include a display screen 30. The display screen 30 may be located at the front surface 27 of the case 20. The first sound entering hole 202 and the second sound entering hole 204 may be spaced apart and formed on a same outer surface of the case 20 of the electronic device 100. That is, the first sound entering hole 202 and the second sound entering hole 204 may be both formed on any one of the bottom surface 21, the top surface 23, the left surface 25, the right surface 26, the front surface 27 or the back surface 28. In this embodiment, the front surface 27 is the surface facing towards the display screen 30, and the back surface 28 is the surface facing opposite to the display screen 30.

In this embodiment, the first sound entering hole 202 and the second sound entering hole 204 may be formed on the bottom surface 21 of the case 20. The first sound entering hole 202 may be closer to the left surface 25 while the second sound entering hole 204 may be closer to the right surface 26.

In other embodiments, the first sound entering hole 202 and the second sound entering hole 204 may be formed on two different outer surfaces of the case 20 of the electronic device 100 respectively. For example, the first sound entering hole 202 and the second sound entering hole 204 may be respectively formed on the bottom surface 21 and the front surface 27, on the bottom surface 21 and the back surface 28, on the bottom surface 21 and the left surface 25, on the bottom surface 21 and the right surface 26, on the top surface 23 and the front surface 27, on the top surface 23 and the back surface 28, on the top surface 23 and the left surface 25, on the top surface 23 and the right surface 26, or on the front surface 27 and the back surface 28.

The connector 42 may connect to the inner surface of the case 20 opposite to the bottom surface 21. The first sound guiding tube 462 may be composed by several straight tubes connected together successively. The first sound guiding tube may include a connecting portion 4621 parallel to the width direction of the case 20 and two extending portion 4623 connected respectively to two opposite ends of the connecting portion 4621. The extending portion 4623 closer to the left surface 25 may be communicated with the first sound entering hole 202, and the extending portion 4623 closer to the right surface 26 may be communicated with the second sound entering hole 204. In this embodiment, the second sound guiding tube 464 may connect to the middle portion of the connecting portion 4621. The connector 46 may be connected to the case 20 with adhesive, and the housing 42 may be connected with the connector 46 with adhesive.

In other embodiments, the second sound guiding tube 464 may connect to the connecting portion 4621 at other position. The connector 46 may be connected with the case 20 by way of clamping. For example, several clips may be set on the connector 46, and several slots corresponding to the clips of the connector 46 may be formed on the case 20. Thus, each clip may be connected to the corresponding slot.

In other embodiments, the connector 46 may be connected with the case 20 by way of screwing. For example, the connector 46 may define several through holes, and the case 20 may define several screw holes corresponding to the through holes of the connector 46. Thus, by using several screws to pass through the through holes and to connect to the screw hole, the connector 46 may be connected with the case 20.

In other embodiments, the connector 46 may be connected to the case 20 by other ways such as melting or welding.

The microphone 40 may further include a print circuit board (PCB) 48. The print circuit board 48 may be electrically connected with the main board (not shown) of the electronic device 100. The vibrating membrane 44 may be set on the PCB 48. The housing 42 may define a cavity 45 for receiving the PCB 48 and the vibrating membrane 44. In this embodiment, the microphone 40 may be a silicon microphone. The microphone 40 may include a micro electro mechanical system (MEMS) chip. The MEMS chip may include the vibrating membrane 44 and the PCB 48. According to the principle of the MEMS chip, the vibrating membrane 44 may deform under the change of sound pressure which is caused by the change of sound, thereby changing the capacitance between the vibrating membrane 44 and the PCB 48. The change of capacitance may be reflected by the change of output voltage of a capacitance-voltage transforming circuit. The sound pressure signals are finally transformed into voltage signals after the output voltage is amplified by an amplification circuit.

Sound may enter the first sound entering hole 202 and the second sound entering hole 204, then enter the first sound guiding tube 462, and at last enter the sound collecting hole 421 through the second sound guiding tube 464. Sound pressure generated by the sound may make the vibrating membrane 44 to deform. Sound pressure signals may be transformed into voltage signals by the PCB 48. Since the electronic device 100 have the first sound entering hole 202 and the second sound entering hole 204, when one of the sound entering holes is blocked by dust or external material, it is still possible to continue to transfer sound pressure to the vibrating membrane 44 through the other sound entering hole, the first sound guiding tube 462 and the second sound guiding tube 464, such that the microphone 40 may operate stably. Similarly, when one of the sound entering hole is block by the hand of the user when the user holds the electronic device 100, it is possible to continue to transfer sound pressure to the vibrating membrane 44 through the other sound entering hole, the first sound guiding tube 462 and the second sound guiding tube 464, such that the microphone 40 may operate stably. It is less probable that a user blocks the first sound entering hole 202 and the second sound entering hole 204 at the same time. Thus, it is ensured that the microphone 40 may operate stably. When dust or external material is found in the first sound entering hole 202, the second sound entering hole 204 or the first sound guiding tube 462, it is possible to make a soft thin rod to enter the second sound entering hole 204, to pass through the first sound guiding tube 462, and to come out from the first sound entering hole 202 in order to push out dust or external material from the first sound entering hole 202. It is also possible to use high-pressure gas to blow into the second sound entering hole 204 so as to remove dust or external material from the first sound entering hole 202. When high-pressure gas is utilized to blow into the second sound entering hole 204, some of the gas can be vent from the first sound entering hole 202. In other words, not all of the high-pressure gas blows directly the vibrating membrane 44. Thus, the air pressure on the vibrating membrane 44 may be reduced so as to prevent the vibrating membrane 44 from damage.

Figure 3:
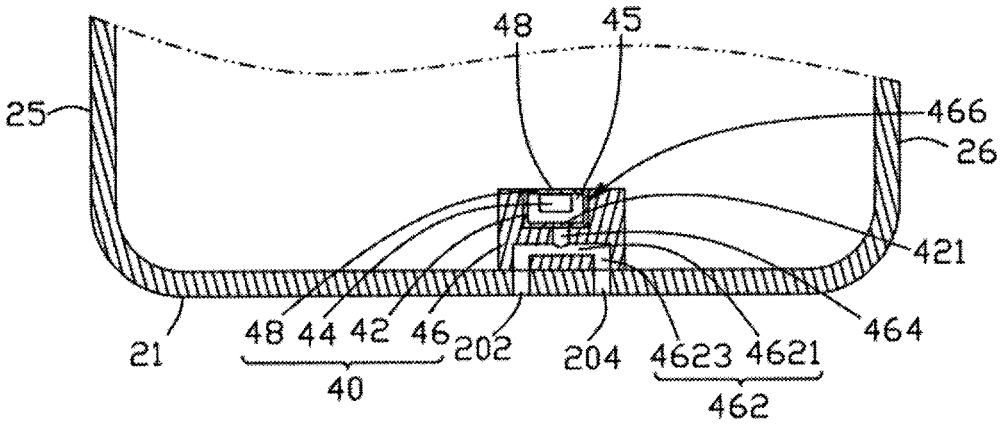
FIG. 3 shows a structural diagram of an electronic device according to another embodiment of the present disclosure.

Referring to FIG. 3, FIG. 3 shows a structural diagram of an electronic device according to another embodiment of the present disclosure. The structure of the electronic device is similar to that described in the above embodiments. However, in this embodiment, the connector 46 may define an accommodating space 466. The housing 42 of the microphone may be received in the accommodating space 466. In this embodiment, the accommodating space 466 may be located at the side of the connector 46 opposite to the first sound entering hole 202 and the second sound entering hole 204, and the accommodating space 466 may be communicated with the second sound guiding tube 464 through the sound collecting hole 421. During assembling, the housing 42 may be directly installed in the accommodating space 466, and the sound collecting hole 421 should be communicated with the second sound guiding tube 464. The accommodating space 466 of the connector 46 may be utilized for receiving the housing 42 of the microphone so as to facilitate the installation of the microphone 40, and to firmly fix the housing 42.

Figure 4:
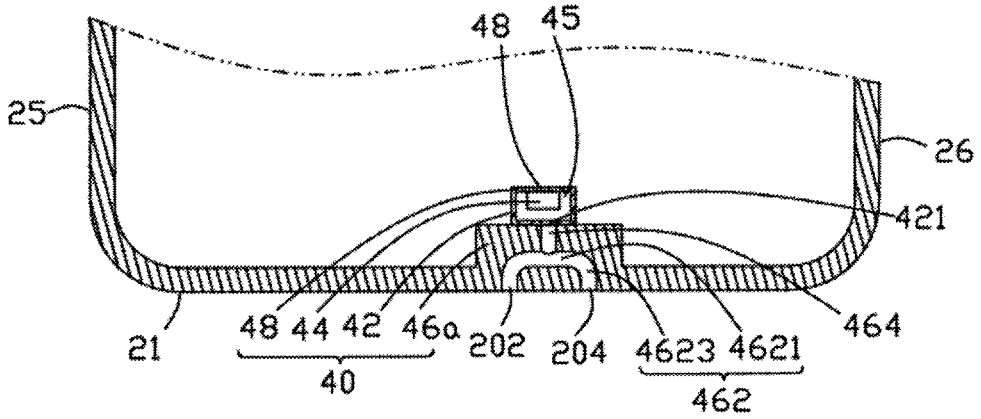
FIG. 4 shows a structural diagram of an electronic device according to another embodiment of the present disclosure.

Referring to FIG. 4, FIG. 4 shows a structural diagram of an electronic device according to another embodiment of the present disclosure. The structure of the electronic device is similar to that described in the above embodiments. However, in this embodiment, the connector 46 may be integrally formed with the case 20. That is, the connector 46*a* of this embodiment may be part of the case 20. By integrally forming the connector 46*a* and the case 20, the manufacturing process of the connector 46 and the case 20 may be simplified such that installation cost may be reduced. In this situation, the openings of the two ends of the first sound guiding tube 462 are respectively the first sound entering hole 202 and the second sound entering hole 204. Thus, cost for forming the holes may be reduced, and the connection between the connector 46 and the case 20 may be stronger. The connecting portion 4621 and each extending portion 4623 of the first sound guiding tube 462 may be smoothly connected by arc transition, which facilitates sound to enter the second sound guiding tube 464, and makes the cleaning of the first sound entering hole 202, the second sound entering hole 204 and the first sound guiding tube 462 easier.

Figure 5:
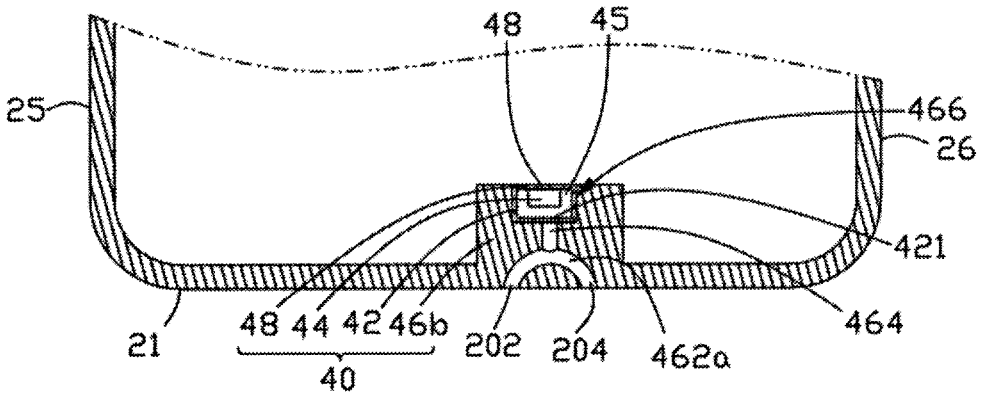
FIG. 5 shows a structural diagram of an electronic device according to another embodiment of the present disclosure.

Referring to FIG. 5, FIG. 5 shows a structural diagram of an electronic device according to another embodiment of the present disclosure. The structure of the electronic device is similar to that described in the above embodiments. However, in this embodiment, the connector 46 may be integrally formed with the case 20. That is, the connector 46*b* may be part of the case 20. In this embodiment, the first sound guiding tube 462*a* may have be an arc-shaped sound guiding tube. The arc-shaped sound guiding tube may tilt towards the vibrating membrane 44. The opening of two ends of the arc-shaped sound guiding tube may be respectively the first sound entering hole 202 and the second sound entering hole 204 of the case 20. One end of the second sound guiding tube 464 may be connected to the top of the first sound guiding tube 462*a*, and the other end of the second sound guiding tube 464 may be communicated with the sound collecting hole 421. The first sound guiding tube 462*a* with an arc configuration may facilitate sound to enter the second sound guiding tube 464, and make the cleaning of the first sound entering hole 202, the second sound entering hole 204 and the first sound guiding tube 462 easier.

Figure 6:
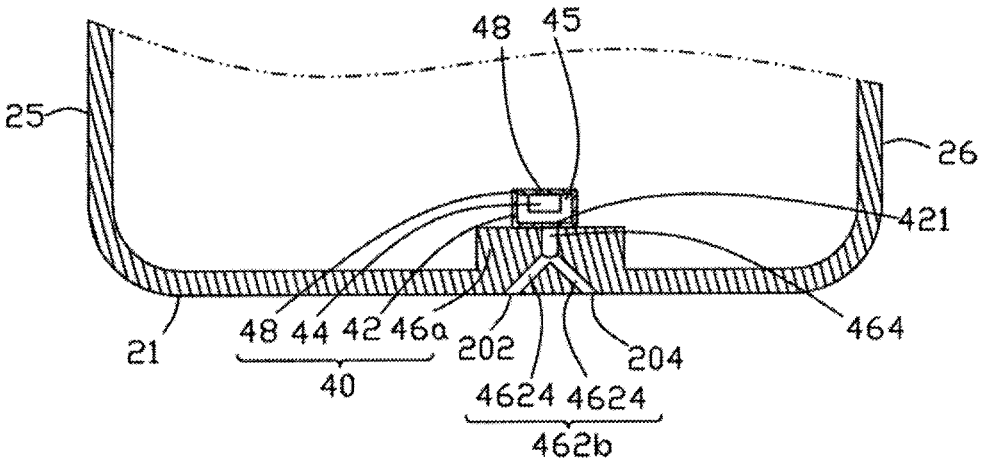
FIG. 6 shows a structural diagram of an electronic device according to another embodiment of the present disclosure.

Referring to FIG. 6, FIG. 6 shows a structural diagram of an electronic device according to another embodiment of the present disclosure. The structure of the electronic device is similar to that described in the above embodiments. However, in this embodiment, the first sound guiding tube 462*b* include two sub-portions 4624 extending respectively from the first sound entering hole 202 and the second sound entering hole 204 and straightly towards the second sound guiding tube 464. The two sub-portions 4624 may be interconnected, and the second sound guiding tube 464 may be connected to the position where the two sub-portions 4624 are interconnected.

Figure 7:
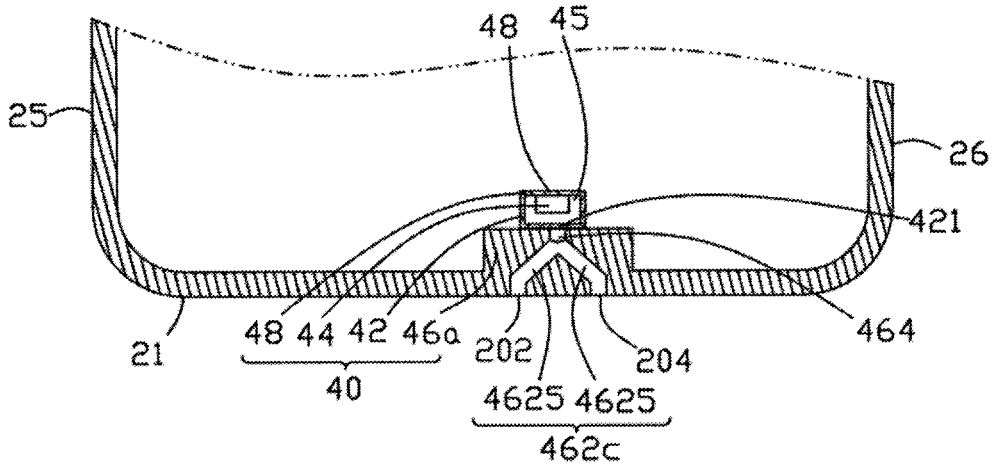
FIG. 7 shows a structural diagram of an electronic device according to another embodiment of the present disclosure.

Referring to FIG. 7, FIG. 7 shows a structural diagram of an electronic device according to another embodiment of the present disclosure. The structure of the electronic device is similar to that described in the above embodiments. However, in this embodiment, the first sound guiding tube 462*c* may include two sub-portions 4625. One of the sub-portions 4625 may firstly extend from the first sound entering hole 202 towards the housing 42, and then tilt towards the second sound guiding tube 464. The other sub-portion 4625 may firstly extend from the second sound entering hole 204 towards the housing 42, and then tilt towards the second sound guiding tube 464. The ends of the two sub-portions 4625 far away from the bottom surface 21 may be interconnected, and the second sound guiding tube 464 may be connected to the position where the two sub-portions 4625 are interconnected.

Figure 8:
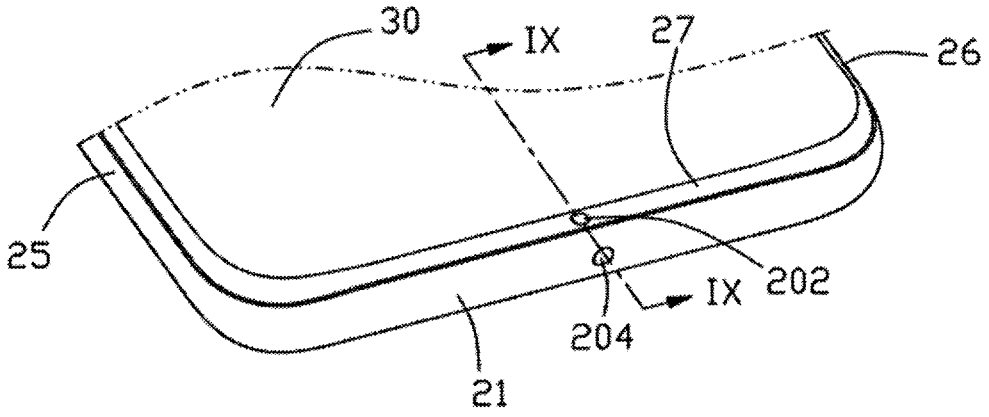
FIG. 8 is a perspective view of part of an electronic device according to another embodiment of the present disclosure.
Figure 9:
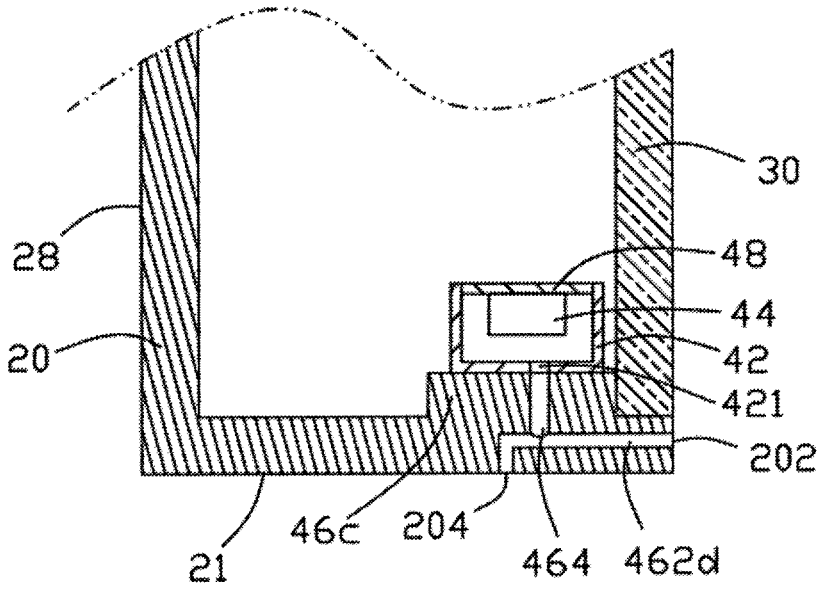
FIG. 9 is a sectional view taken along the line IX-IX of FIG. 8.

Referring to FIGS. 8 and 9, FIG. 8 is a perspective view of an electronic device according to an embodiment of the present disclosure, and FIG. 9 shows a sectional view taken from the line IX-IX of FIG. 8. The structure of the electronic device in this embodiment is similar to that described in the above embodiments. However, in this embodiment, the connector 46 may be integrally formed with the case 20. That is, the connector 46*c* may be part of the case 20. The first sound entering hole 202 may be formed on the front surface 27, and located close to the bottom surface 21. The second sound entering hole 204 may be formed on the bottom surface 21, and located close to the first sound entering hole 202. In other words, the first sound entering hole 202 and the second sound entering hole 204 may be respectively formed on two adjacent outer surfaces of the case 20 of the electronic device 100. The two ends of the first sound guiding tube 462*d* may be respectively communicated with the first sound entering hole 202 and the second sound entering hole 204. Specifically, the first sound entering tube 462*d* may firstly extending from the first sound entering hole 202 towards the back surface 28, and then tilt towards the bottom surface 21 to connect the second sound entering hole 204. One end of the second sound guiding tube 464 may be communicated with the first sound guiding tube 462*d*, and the other end of the second sound guiding tube 464 may be communicated with the sound collecting hole 421.

In other embodiments, the first sound guiding tube 462*d* may have arc transition.

Figure 10:
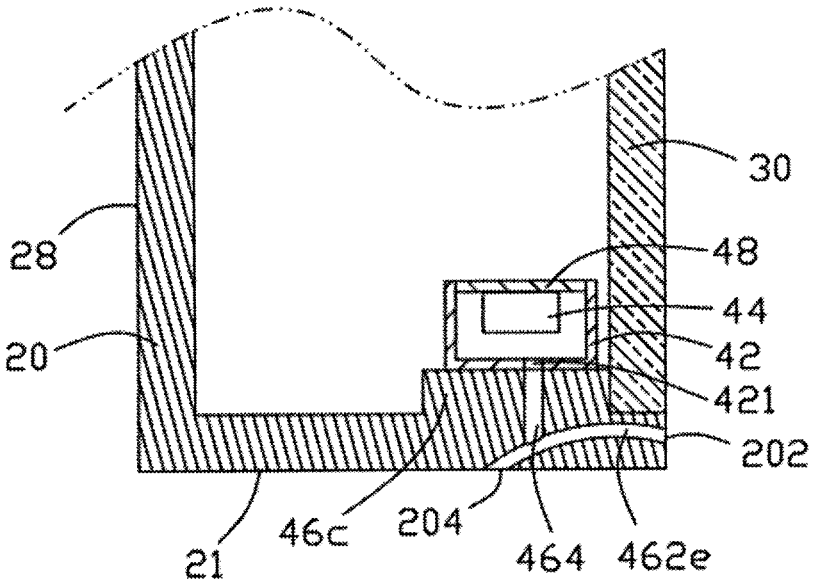
FIG. 10 shows a structural diagram of an electronic device according to another embodiment of the present disclosure.

Referring to FIG. 10, FIG. 10 shows a structural diagram of an electronic device according to another embodiment of the present disclosure. The structure of the electronic device is similar to that described in the above embodiment. However, in this embodiment, the first sound guiding tube 462*e* may be an arc-shaped sound guiding tube. Two ends of the arc-shaped sound guiding tube may be respectively communicated with the first sound entering hole 202 and the second sound entering hole 204. One end of the second sound guiding tube 464 may be communicated with the first sound guiding tube 462*e*, and the other end of the second sound guiding tube 464 may be communicated with the sound collecting hole 421.

In other embodiment, the first sound entering hole 202 may be formed on the bottom surface 21, and the second sound entering hole 204 may be formed on the back surface 28 and located close to the first sound entering hole 202. The first sound guiding tube may be communicated with the first sound entering hole 202 and the second sound entering hole 204. The first sound guiding tube may have a straight configuration or an arc configuration.

In other embodiments, the first sound entering hole 202 may be formed on the front surface 27, and the second sound entering hole 204 may be formed on the back surface 28 close to the first sound entering hole 202. That is, the first sound entering hole 202 and the second sound entering hole 204 may be respectively formed on two opposite outer surfaces of the case 20 of the electronic device 100. The first sound guiding tube may be communicated with the first sound entering hole 202 and the second sound entering hole 204. The first sound guiding tube may have a straight configuration or an arc configuration.

Figure 11:
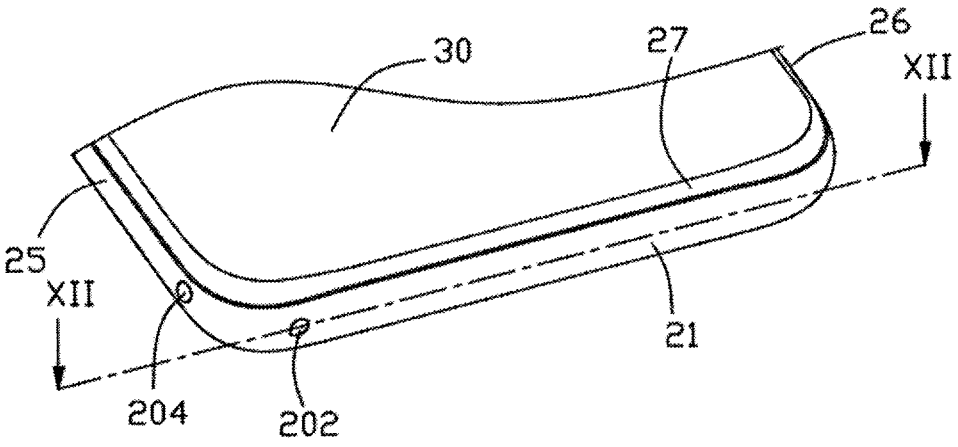
FIG. 11 is a perspective view of part of an electronic device according to another embodiment of the present disclosure.
Figure 12:
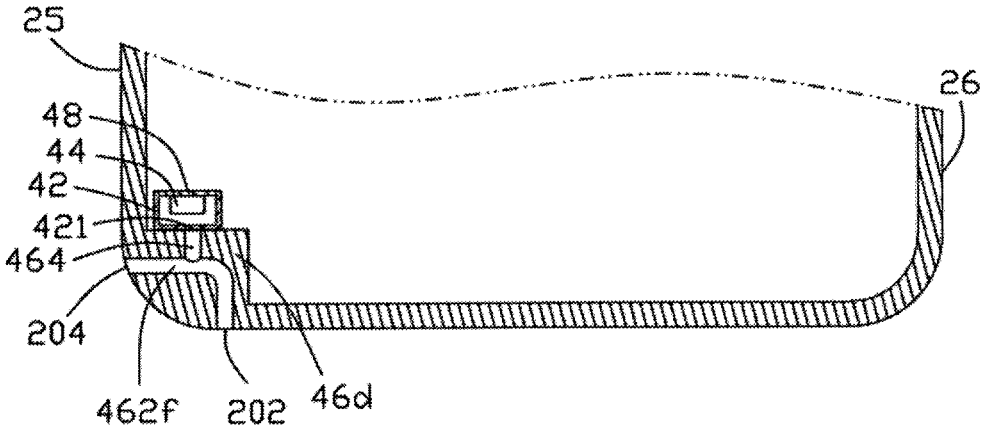
FIG. 12 is a sectional view taken along the line XII-XII of FIG. 11.

Referring to FIGS. 11 and 12, FIG. 11 is a perspective view of an electronic device according to another embodiment of the present disclosure, and FIG. 12 is a sectional view taken along the line XII-XII of FIG. 11. The structure of the electronic device is similar to that described in the above embodiments. However, in this embodiment, the connector 46 may be integrally formed with the case 20. The connector 46*d* may be part of the case 20. The connector 46*d* may be located at the corner between the bottom wall and the left wall of the case 20. The first sound entering hole 202 may be formed on the bottom surface 21 and located close to the left surface 25. The second sound entering hole 204 may be formed on the left surface 25 and located close to the first sound entering hole 202. The two ends of the first sound guiding tube 462*f* may be respectively communicated with the first sound entering hole 202 and the second sound entering hole 204. The first sound guiding tube 462*f* may firstly extend from the first sound entering hole 202 towards the housing 42, and then tilt towards the left surface 25 to connect to the second sound entering hole 204. The first sound guiding tube 462*f* may have arc-shaped transition. One end of the second sound guiding tube 464 may be communicated with the first sound guiding tube 462*f*, and the other end of the second sound guiding tube 464 may be communicated with the sound collecting hole 421.

In other embodiments, the first sound entering hole 202 may be formed on the bottom surface 21 and located close to the right surface 26. The second sound entering hole 204 may be formed on the right surface 26 close to the first sound entering hole 202. The connector may be integrally formed with the case. The connector may be disposed at the corner between the bottom wall and the right wall of the case. The two ends of the first guiding tube may be respectively communicated with the first sound entering hole 202 and the second sound entering hole 204. The first sound guiding tube may firstly extend from the first sound entering hole 202 towards the housing 42, and then tilt towards the right surface 26 to connect to the second sound entering hole 204. The first sound guiding tube may have arc-shaped transition. One end of the second sound guiding tube 464 may be communicated with the first sound guiding tube, and the other end of the sound guiding tube 464 may be communicated with the sound collecting hole 421.

Figure 13:
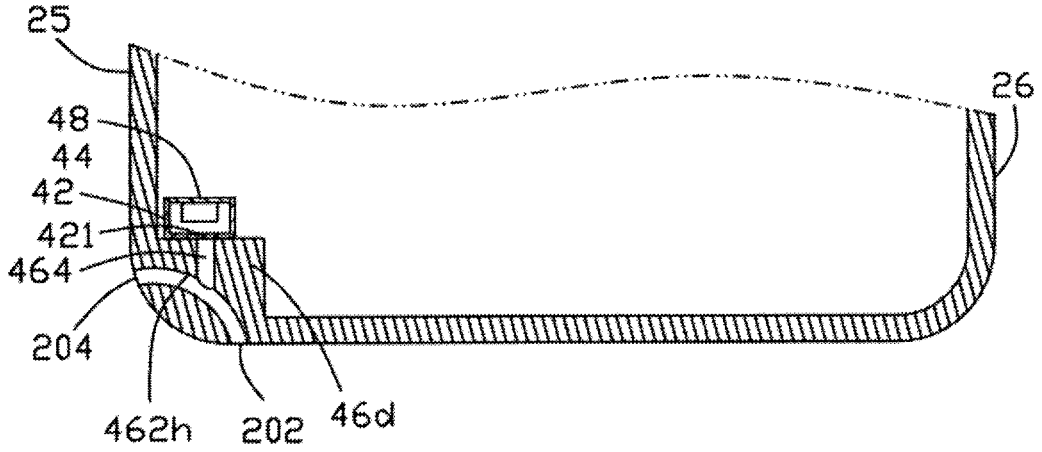
FIG. 13 shows a structural diagram of an electronic device according to another embodiment of the present disclosure.

Referring to FIG. 13, FIG. 13 shows a structural diagram of an electronic device according to another embodiment of the present disclosure. The structure of the electronic device is similar to that described in the above embodiments. However, in this embodiment, the first sound guiding tube 462*h* may be an arc-shaped sound guiding tube. The two ends of the arc-shaped sound guiding tube may be communicated respectively with the first sound entering hole 202 and the second sound entering hole 204. One end of the second sound guiding tube 464 may be communicated with the first sound guiding tube 462*h*, and the other end of the sound guiding tube 464 may be communicated with the sound collecting hole 421.

The foregoing is merely embodiments of the present disclosure. It should be pointed out that for those skilled in the art, a number of improvements and modifications may be made without departing from the principle of the embodiments of the present disclosure. These improvements and modifications should also be considered in the scope of the present disclosure.

What is claimed is:

1. A microphone adapted to be installed inside a case of an electronic device, wherein the case of the electronic device defines a first sound entering hole and a second sound entering hole, the microphone comprising:

a housing;

a vibrating membrane set inside the housing, wherein the housing defines a sound collecting hole facing the vibrating membrane; and a connector adapted to connect the housing with the case of the electronic device and defining a first sound guiding tube and a second sound guiding tube;

wherein one end of the first sound guiding tube is communicated with the first sound entering hole while the other end of the first sound guiding tube is communicated with the second sound entering hole, a first end of the second sound guiding tube is communicated with the first sound guiding tube, and a second end of the second sound guiding tube is communicated with the sound collecting hole; and wherein the connector defines an accommodating space, the housing and the vibrating membrane are received in the accommodating space, the accommodating space is communicated with the second sound guiding tube, and the sound collecting hole is communicated with the second sound guiding tube.

2. The microphone of claim 1, wherein the first end of the second sound guiding tube connects to a middle portion of the first sound guiding tube.

3. The microphone of claim 1, wherein the first sound guiding tube has a straight configuration or an arc configuration.

4. The microphone of claim 3, wherein the first sound guiding tube comprises a plurality of straight tubes connected together successively, and each two adjacent ones of the plurality of straight tubes are smoothly connected by arc transition.

5. The microphone of claim 1, wherein the connector and the case of the electronic device are integrally formed.

6. The microphone of claim 1, wherein the first sound entering hole and the second sound entering hole are spaced apart and located on a same outer surface of the case of the electronic device.

7. The microphone of claim 1, wherein the first sound entering hole and the second sound entering hole are located on two different outer surfaces of the case of the electronic device.

8. The microphone of claim 7, wherein the first sound entering hole and the second sound entering hole are formed on two adjacent outer surfaces of the case of the electronic device.

9. The microphone of claim 7, wherein the first sound entering hole and the second sound entering hole are formed on two opposite outer surfaces of the case of the electronic device.

10. An electronic device comprising:

a case defining a first sound entering hole and a second sound entering hole;

a microphone, comprising:

a housing; and a vibrating membrane set inside the housing, wherein the housing defines a sound collecting hole facing the vibrating membrane; and a connector connecting the housing of the microphone and the case, and defining a first sound guiding tube and a second sound guiding tube;

wherein one end of the first sound guiding tube is communicated with the first sound entering hole while the other end of the first sound guiding tube is communicated with the second sound entering hole, a first end of the second sound guiding tube is communicated with the first sound guiding tube, and a second end of the second sound guiding tube is communicated with the sound collecting hole; and wherein the connector defines an accommodating space, the housing and the vibrating membrane are received in the accommodating space, the accommodating space is communicated with the second sound guiding tube, and the sound collecting hole is communicated with the second sound guiding tube.

11. The electronic device of claim 10, wherein the first sound entering hole and the second sound entering hole are spaced apart, and formed on a same outer surface of the case of the electronic device.

12. The electronic device of claim 10, wherein the first sound entering hole and the second sound entering hole are formed on two adjacent outer surfaces of the case of the electronic device.

13. The electronic device of claim 10, wherein the first sound entering hole and the second sound entering hole are formed on two opposite outer surfaces of the case of the electronic device.

14. The electronic device of claim 10, wherein the connector is integrally formed with the case.

15. A mobile terminal, comprising:

a case defining a first sound entering hole and a second sound entering hole, wherein the first and second sound entering holes are communicated with inside and outside of the case;

a microphone received in the case and comprising:

a housing defining a sound collecting hole;

a vibrating membrane connected with the housing, wherein the sound collecting hole faces the vibrating membrane;

a first sound guiding tube formed in the case, and communicated with the first sound entering hole and the second sound entering hole; and a second sound guiding tube formed in the case, and communicated with the first sound guiding tube and the sound collecting hole; and wherein the case defines an accommodating space, the housing and the vibrating membrane are received in the accommodating space, the accommodating space is communicated with the second sound guiding tube, and the sound collecting hole is communicated with the second sound guiding tube.

16. The mobile terminal of claim 15, wherein the case comprises a plurality of side walls comprising a top wall, a bottom wall, a front wall, a back wall, a left wall and a right wall, the plurality of side walls are connected together;

the first sound entering hole and the second sound entering hole are both formed in a same one selected from the plurality of side walls.

17. The mobile terminal of claim 15, wherein the case comprises a plurality of side walls comprising a top wall, a bottom wall, a front wall, a back wall, a left wall and a right wall, the plurality of side walls are connected together;

the first sound entering hole and the second sound entering hole are respectively formed in two adjacent ones or two opposite ones selected from the plurality of side walls.

* * * * *